US008525362B2

(12) United States Patent
Herzog et al.

(10) Patent No.: US 8,525,362 B2
(45) Date of Patent: Sep. 3, 2013

(54) STEAM TURBINE PLANT

(75) Inventors: Maurus Herzog, Schinznach Dorf (CH); Wilhelm Reiter, Küssaberg (DE)

(73) Assignee: Alstom Technology Ltd, Baden (CH)

( * ) Notice: Subject to any disclaimer, the term of this patent is extended or adjusted under 35 U.S.C. 154(b) by 181 days.

(21) Appl. No.: 13/223,840

(22) Filed: Sep. 1, 2011

(65) Prior Publication Data

US 2012/0223532 A1 Sep. 6, 2012

(30) Foreign Application Priority Data

Sep. 3, 2010 (IT) ..... MI2010A1599

(51) Int. Cl.
*F01D 15/10* (2006.01)

(52) U.S. Cl.
USPC ..... 290/52

(58) Field of Classification Search
USPC ..... 290/52
See application file for complete search history.

(56) References Cited

U.S. PATENT DOCUMENTS

| | | | | |
|---|---|---|---|---|
| 4,519,207 | A * | 5/1985 | Okabe et al. | 60/39.182 |
| 5,051,061 | A | 9/1991 | Meylan | |
| 5,347,814 | A | 9/1994 | Kemmer et al. | |
| 7,317,268 | B2 * | 1/2008 | Bray et al. | 310/61 |
| 2003/0175117 | A1 | 9/2003 | Klaus et al. | |
| 2006/0182621 | A1 * | 8/2006 | Laskaris et al. | 415/1 |
| 2009/0107532 | A1 * | 4/2009 | Lonne et al. | 134/56 R |
| 2010/0038917 | A1 | 2/2010 | DiAntonio et al. | |

FOREIGN PATENT DOCUMENTS

| | | |
|---|---|---|
| DE | 1 551 257 | 2/1970 |
| DE | 141 335 | 4/1980 |
| DE | 692 20 240 T2 | 1/1998 |
| EP | 0 374 645 A1 | 6/1990 |
| EP | 1 335 110 A1 | 8/2003 |
| EP | 1 688 173 A2 | 8/2006 |
| GB | 100369 A | 4/1917 |
| GB | 102741 A | 6/1917 |
| GB | 108118 A | 7/1917 |

OTHER PUBLICATIONS

Italian Search Report (EPO Form 1503) dated Jun. 15, 2011.
Italian Written Opinion (Form IT237) dated Sep. 3, 2010.
Justin Zachary, "Option for reducing a coal-fired plant's carbon footprint: Part I", Bechtel Power Corp., Jun. 15, 20089 pages.
German Search Report issued Jul. 20, 2012 in corresponding German Patent Application No. 10 2011 111 707.9.

* cited by examiner

*Primary Examiner* — Tho D Ta
(74) *Attorney, Agent, or Firm* — Buchanan Ingersoll & Rooney PC

(57) ABSTRACT

A single shaft steam turbine plant is disclosed with a first and a second low pressure steam turbine located at either end of the shaft. A generator and at least one high-pressure steam turbine are located on the shaft between low pressure steam turbines.

14 Claims, 2 Drawing Sheets

STEAM TURBINE PLANT

RELATED APPLICATION

This application claims priority under 35 U.S.C. §119 to Italian Patent Application No. MI 2010 A 001599 filed in Italy on Sep. 3, 2010, the entire content of which is hereby incorporated by reference in its entirety.

FIELD

The disclosure relates to steam turbine plants and to the integration of steam turbine plants designed and arranged for supplying intermediate steam to intermittent high demand steam consumers.

BACKGROUND INFORMATION

A challenge for single shaft steam turbine plants with steam off-takes for high demand users is to operate in an efficient manner while minimizing shaft peak torque stress. Peak torque can be created by the difference between the resistance created by a generator, for example, located on the shaft, and a series of steam turbines.

A carbon capture and sequestration unit in an example of a high demand steam consumer, is described in EP 1688173. Known steam turbine plant arrangements for the efficient supply of energy and steam to the high demand steam consumer are described in Zachary, J (June 2008), "Options for reducing a coal-fired plant's carbon foot print: Part I", POWER 28-33 (Zachary). The described arrangements include single shaft steam turbines arranged in series with multiple low pressure steam turbines. U.S. Patent Application No. US 2010/0038917 discloses a single shaft steam turbine plant with intermediate off-takes for a high demand user.

SUMMARY

A steam turbine plant is disclosed which includes a shaft with first and second ends, a first low pressure steam turbine and a second low pressure steam turbine at the first and second ends of the shaft respectively, a generator on the shaft between the first low pressure steam turbine and the second low pressure steam turbine; and a steam turbine train, on the shaft between the first and second low pressure steam turbines, the steam turbine train including at least one high-pressure steam turbine.

A method is disclosed of operating a steam turbine power plant which includes a shaft with first and second ends; a first low pressure steam turbine and a second low pressure steam turbine at the first and second ends of the shaft respectively; a generator on the shaft between the first low pressure steam turbine and second low pressure steam turbines; a steam turbine train, on the shaft between the first and second low pressure steam turbines, the steam turbine train including at least one high-pressure steam turbine; a first feed line, connecting the steam turbine train to the first low pressure steam turbine; and a first off-take, in the first feed line, for supplying steam to a high demand steam consumer, wherein the method comprises: identifying peak and non-peak electricity price periods, selectively operating and closing the first off-take valve to supply steam to a high-demand customer during a non-peak period and not supply steam to the high demand customer during a peak period.

A method is disclosed of operating a steam turbine power plant which includes: a shaft with first and second ends; a first low pressure steam turbine and a second low pressure steam turbine at the first and second ends of the shaft respectively; a generator on the shaft between the first low pressure steam turbine and second low pressure steam turbines; a steam turbine train, on the shaft between the first and second low pressure steam turbines, the steam turbine train including at least one high-pressure steam turbine; a first feed line, connecting the steam turbine train to the first low pressure steam turbine; and a first off-take, in the first feed line, for supplying steam to a high demand steam consumer, wherein the method comprises: identifying peak and high and low grid demand periods; and selectively operating and closing the first off-take valve to supply steam to a high-demand customer during a high and low grid demand periods and not supply steam to the high demand customer during a peak period.

BRIEF DESCRIPTION OF THE DRAWINGS

Exemplary embodiments of the present disclosure are described more fully hereinafter with reference to the accompanying drawings, in which.

DETAILED DESCRIPTION

In the following description, for purposes of explanation, numerous specific details are set forth to provide a thorough understanding of exemplary embodiments. It will be evident, however, that embodiments may be practiced without these specific details. In other instances, structures and devices are shown in block form in order to facilitate description of the exemplary embodiments.

Throughout this specification, reference is made to "steam turbine trains." Within this specification, a "steam turbine train" can be defined as a series of steam turbines of different pressure configurations on a single shaft 22. The steam turbine train 12 can include some or all of a series of steam turbines arranged on the single shaft 22

Throughout this specification, reference is made to "high demand steam consumer." A "high demand steam consumer" can be defined as a steam consumer that is capable of demanding a steam rate equivalent to a low pressure steam turbine within the steam plant. An example of such a steam consumer is a carbon capture unit.

A single shaft steam turbine plant, configured for intermediate steam extraction, is disclosed that can limit the peak shaft torque through a high-pressure steam turbine of the plant throughout various modes of operation.

An exemplary embodiment of the disclosure provides a single shaft steam turbine with low pressure steam turbines at either end of the shaft. A generator and a high-pressure steam turbine is located between the low pressure steam turbines. This arrangement can ensure the total torque from the low pressure steam turbines does not pass through the high pressure steam turbine, thus enabling the shaft portion through the high pressure steam turbine to be designed for lower torque.

Exemplary embodiments provide clutches and intermediate user off take arrangements that can provide operational and maintenance flexibility.

Exemplary embodiments provide clutches and intermediate user off take arrangements that can provide operational and maintenance flexibility.

Reference will now be made to details of exemplary embodiments, examples of which are illustrated in the accompanying drawings. Wherever possible, the same reference numbers will be used throughout in order to refer to the same or like parts.

Figure 1:
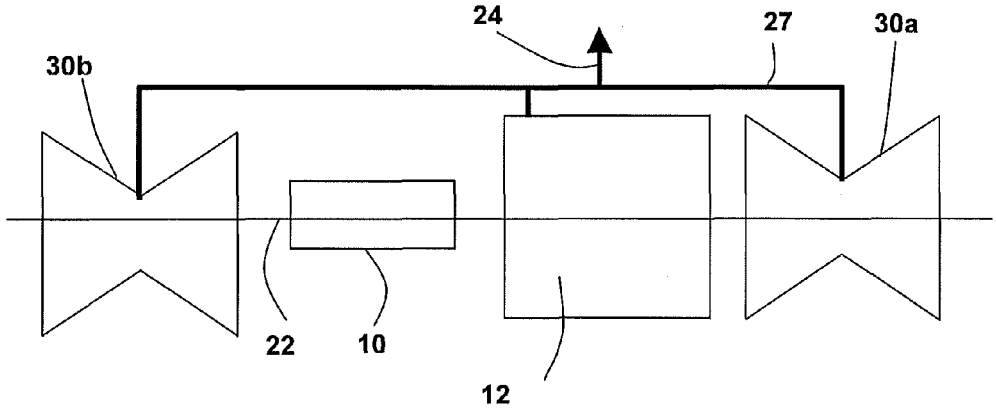
FIG. 1 is a schematic view of an exemplary embodiment of a steam turbine plant.

FIG. 1 shows an exemplary steam turbine plant including a shaft 22, with a series of steam turbines and a generator 10 located thereon. The steam turbines include a steam turbine train 12 and first and second low pressure steam turbines 30*a*, 30*b*. The low pressure steam turbines 30*a*,30*b* are located at either end of the steam turbine plant and can be in steam communication with the steam turbine train 12 by a feed line 27. An off-take 24 for a high demand steam consumer can be located on this feed line 27.

By locating the low pressure steam turbine 30*a* and the generator 10 on opposite ends of the shaft 22, the torque load through the high-pressure steam turbine 14 can be reduced. To further reduce the torque load through the high-pressure steam turbine 14, in the steam train 12 shown in FIG. 2, the position of the high-pressure steam turbine 14 and medium-pressure steam turbine 16 can be located swapped such that the medium-pressure steam turbine 16, rather than the high-pressure steam turbine 14 is located adjacent the generator 10.

Figure 2:
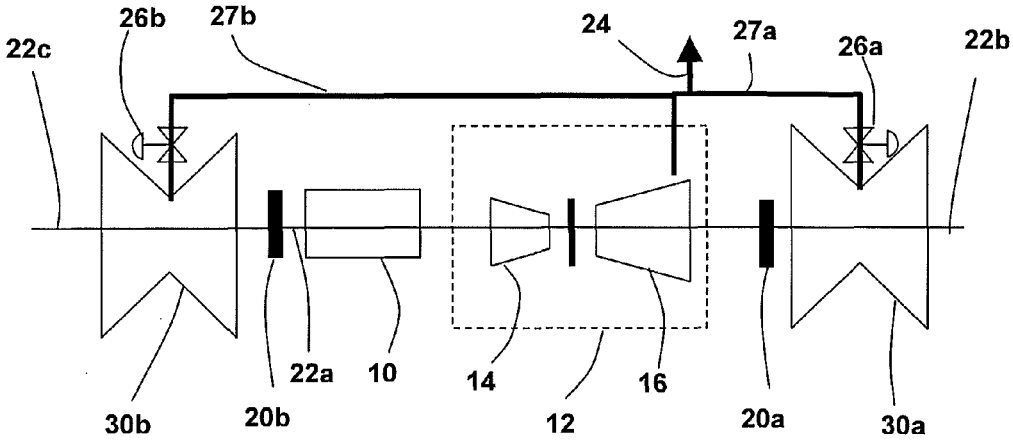
FIG. 2 is a schematic view of an exemplary embodiment of a steam turbine plant that incorporates the steam turbine plant of FIG. 1 and has a shaft with three shaft portions.

FIG. 2 shows an exemplary steam turbine plant that includes a shaft 22 that has three portions 22*a*, 22*b*, 22*c* joined by first and second clutches 20*a*, 20*b*. The first clutch 20*a* joins the first and second shaft portions 22*a*, 22*b* while a second clutch 20*b* joins the first and third shaft portions 22*a*, 22*c*. The second shaft portion 22*b* and third shaft portion 22*c* have a first low pressure steam turbine 30*a* and a second low pressure steam turbine 30*b* located on them respectively, while the first shaft portion 22*a* includes a generator 10 and a steam turbine train 12. In an exemplary embodiment the steam turbine train 12 can be located between the generator 10 and the first low pressure steam turbine 30*a*. By use of clutches 20*a*, 20*b* it can be possible to shutdown and provide maintenance for any one of the low pressure steam turbines 30*a*, 30*b* while the rest of the steam plant is operational. This may be done when, for example, steam is being extracted via the off-take 24.

In an exemplary embodiment, shown in FIG. 2, the steam turbine train 12 can include a series of turbines, which, extending from the first low pressure steam turbine 30*a*, includes an intermediate-pressure steam turbine 16 and a high-pressure steam turbine 14. Joining the intermediate-pressure steam turbine 16 to the low pressure steam turbines 30*b*, 30*a* are respective feed lines, 27*a*, 27*b*. Typically, these lines can each have a throttle valve 26*a*, 26*b* for throttling steam flow to the respective low pressure steam turbines 30*a*, 30*b* which when operationally coupled to off-takes 24*a*, 24*b* (shown in FIG. 3), provide a means for efficiently balancing the load between the low pressure steam turbines 30*a*, 30*b*.

Figure 3:
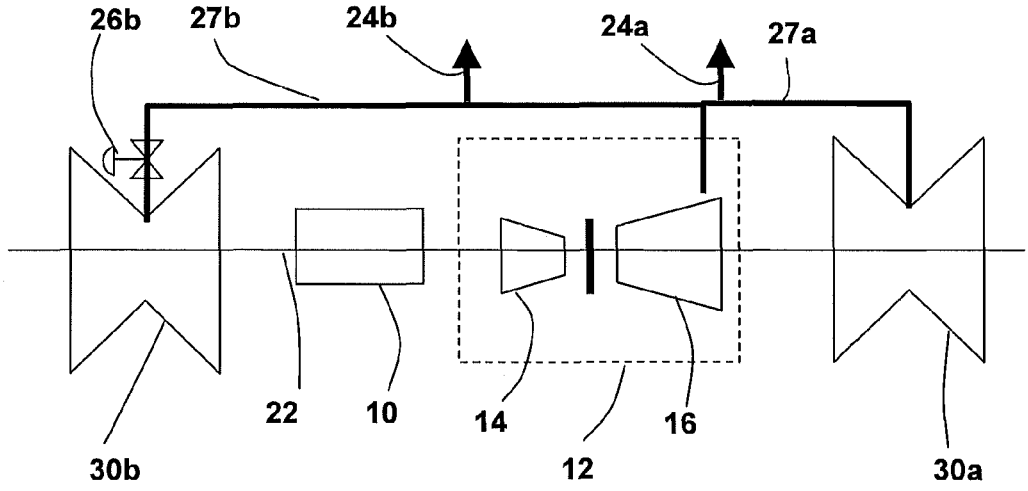
FIG. 3 is a schematic view of an exemplary embodiment of a steam turbine plant that incorporates the steam turbine plant of FIG. 1 and has, a shaft with one shaft portion, and two off-takes.

FIG. 3 shows another exemplary steam turbine plant that includes a shaft 22 with a clutch on which two low pressure steam turbines 30*a*, 30*b* are located at either end of the shaft 22. A generator 10 and a steam turbine train 12 including an intermediate-pressure steam turbine 16, and a high-pressure steam turbine 14 can be located between the low pressure steam turbines 30*a*, 30*b* positioned at either end of the shaft 22. Joining the intermediate-pressure steam turbine 16 to the low pressure steam turbines 30*a*, 30*b* are respective feed lines, 27*a*, 27*b*. The feed line 27*b* includes a throttle valve 26*b* for throttling steam flow to the respective low pressure steam turbine 30*b*. At least one of the feed lines 27*a*, 27*b* can be fitted with an off-take 24*a*, 24*b* for a high demand steam consumer.

An exemplary embodiment provides a method of operating, for example, an electrical supply plant. The method first involves providing a steam turbine plant, as shown in the FIGS. 1-3 as previously described and includes identifying periods of peak electricity prices, for example, lunch time, evenings and weekdays, when peak electricity prices can be up to ten times higher than during base load operation. During these identified periods, the off-take(s) 24*a*, 24*b* for the high demand steam consumer, for example a $CO_2$ capture plant, can be closed, resulting in loading of all steam turbines, thus enabling maximum electricity output.

In contrast, when a period of more moderate electricity prices is identified, the off-take(s) 24*a*, 24*b* to the high demand steam consumer is/are opened to supply, for example, a $CO_2$ capture unit. During this operational mode, as steam is diverted from at least one of the low pressure steam turbines 30*a*, 30*b* electricity output of the power plant is reduced.

This exemplary method can optimize the profit of operating the steam turbine plant by maximizing electricity production during peak electricity prices, while maximizing CO2 capture during low electricity prices.

Alternatively, the off-take 24 and a CO2 capture plant may be operated during low grid demand as an alternative to operating at reduced feed rate to the medium-pressure steam turbine 16 and/or high pressure steam turbine 14 which can lead to a low efficiency operation. In this operating configuration, the power output can be rapidly increased by closing the off-take 24 and directing steam to the low pressure steam turbine 30*a*, 30*b* without the need to increase steam rates to the plant.

Although the disclosure has been herein described in what is conceived to be the most practical exemplary embodiments, it will be appreciated by those skilled in the art that the present disclosure can be embodied in other specific forms without departing from the essential characteristics thereof. For example, the describe steam turbines may be either single flow or double flow steam. Alternatively the low pressure steam turbines 30*a*, 30*b* may be sized differently in order to provided swallowing capacity so that the mass flow distribution between them may be matched to the demand of the steam consumer. The presently disclosed embodiments are therefore considered in all respects to be illustrative and not restricted.

Thus, it will be appreciated by those skilled in the art that the present invention can be embodied in other specific forms without departing from the spirit or essential characteristics thereof. The scope of the invention is indicated by the appended claims rather than the foregoing description and all changes that come within the meaning and range and equivalence thereof are intended to be embraced therein.

REFERENCE SIGNS

10 Generator
12 Steam turbine train
14 High-pressure steam turbine
16 Intermediate-pressure steam turbine
20*a*, 20*b* clutch
22, 22*a*,22*b*,22*c* Shaft
24, 24*a*,24*b* Off-take
26*a*,26*b* Throttle valve
27,27*a*,27*b* Feed line
28*a*,28*b* Exhaust line
30*a*,30*b* Low pressure steam turbine

What is claimed is:

1. A steam turbine plant comprising:

a shaft with first and second ends;

a first low pressure steam turbine and a second low pressure steam turbine at the first and second ends of the shaft respectively;

a generator on the shaft between the first low pressure steam turbine and the second low pressure steam turbine; and a steam turbine train, on the shaft between the first and second low pressure steam turbines, the steam turbine train including at least one high-pressure steam turbine.

2. The steam turbine plant of claim 1, comprising:

a first feed line, connecting the steam turbine train to the first low pressure steam turbine; and a first off-take, in the first feed line, for supplying steam to a high demand steam consumer.

3. The steam turbine plant of claim 2, comprising:

a second feed line joining the steam turbine train to the second low pressure steam turbine; and a second off-take, in the second feed line, for supplying steam to a high demand steam consumer.

4. The steam turbine plant of claim 1, comprising:

a first clutch, on the shaft, between the first low pressure steam turbine and the generator; and a second clutch, on the shaft, between the second low pressure steam turbine and the steam turbine train.

5. The steam turbine plant of claim 1, wherein the shaft does not include a clutch.

6. The steam turbine plant of claim 3, comprising:

a first throttle valve, in the first feed line, downstream of the first off-take; and a second throttle valve, in the second feed line, downstream of the first off-take.

7. The steam turbine plant of claim 2, comprising:

a first clutch, on the shaft, between the first low pressure steam turbine and the generator; and a second clutch, on the shaft, between the second low pressure steam turbine and the steam turbine train.

8. The steam turbine plant of any one of claim 3, comprising:

a first clutch, on the shaft, between the first low pressure steam turbine and the generator; and a second clutch, on the shaft, between the second low pressure steam turbine and the steam turbine train.

9. The steam turbine plant of claim 2, wherein the shaft does not include a clutch.

10. The steam turbine plant of claim 3, wherein the shaft does not include a clutch.

11. The steam turbine plant of claim 8, comprising:

a first throttle valve, in the first feed line, downstream of the first off-take; and a second throttle valve, in the second feed line, downstream of the second off-take.

12. The steam turbine plant of claim 10, comprising:

a first throttle valve, in the first feed line, downstream of the first off-take; and a second throttle valve, in the second feed line, downstream of the second off-take.

13. A method of operating a steam turbine power plant which includes:

a shaft with first and second ends;

a first low pressure steam turbine and a second low pressure steam turbine at the first and second ends of the shaft respectively;

a generator on the shaft between the first low pressure steam turbine and second low pressure steam turbines;

a steam turbine train, on the shaft between the first and second low pressure steam turbines, the steam turbine train including at least one high-pressure steam turbine;

a first feed line, connecting the steam turbine train to the first low pressure steam turbine; and a first off-take, in the first feed line, for supplying steam to a high demand steam consumer; wherein the method comprises:

identifying peak and non-peak electricity price periods; and selectively operating and closing the first off-take valve to supply steam to a high-demand customer during a non-peak period and not supply steam to the high demand customer during a peak period.

14. A method of operating a steam turbine power plant which includes:

a shaft with first and second ends;

a first low pressure steam turbine and a second low pressure steam turbine at the first and second ends of the shaft respectively;

a generator on the shaft between the first low pressure steam turbine and second low pressure steam turbines;

a steam turbine train, on the shaft between the first and second low pressure steam turbines, the steam turbine train including at least one high-pressure steam turbine;

a first feed line, connecting the steam turbine train to the first low pressure steam turbine, a first off-take, in the first feed line, for supplying steam to a high demand steam consumer, wherein the method comprises:

identifying peak and high and low grid demand periods; and selectively operating and closing the first off-take valve to supply steam to a high-demand customer during a high and low grid demand periods and not supply steam to the high demand customer during a peak period.

* * * * *